United States Patent [19]

Mulcahy et al.

[11] Patent Number: 5,001,989

[45] Date of Patent: Mar. 26, 1991

[54] SINGLE AXLE SUSPENSION SYSTEM FOR RAILWAY CAR TRUCK

[75] Inventors: Harry W. Mulcahy, Griffith, Ind.; Robert P. Radwill, Vero Beach, Fla.

[73] Assignee: AMSTED Industries Incorporated, Chicago, Ill.

[21] Appl. No.: 312,195

[22] Filed: Feb. 21, 1989

[51] Int. Cl.[5] ..... B61F 3/00

[52] U.S. Cl. ..... 105/199.5; 267/4; 105/453

[58] Field of Search ..... 105/199.5, 199.2, 199.1, 105/197.05, 198.2–198.7, 224.05, 453, 157.1, 171, 207; 267/3, 4, 6, 170

[56] References Cited

U.S. PATENT DOCUMENTS

| | | | |
|---|---|---|---|
| 3,577,931 | 5/1971 | Shafer | 267/4 X |
| 3,601,063 | 8/1971 | Dean | 267/4 X |
| 3,646,893 | 3/1972 | Sundby | 105/199.1 X |
| 3,682,103 | 8/1972 | Schwam | 105/199.2 |
| 3,762,694 | 10/1973 | MacDonnell | 267/3 |
| 3,865,045 | 2/1975 | Jones, Jr. | 105/197.05 X |
| 4,067,261 | 1/1978 | Scheffel | 105/199.1 X |
| 4,109,586 | 8/1978 | Briggs et al. | 267/3 X |
| 4,445,439 | 5/1984 | Tilly et al. | 105/199.5 X |
| 4,480,555 | 11/1984 | Shafer et al. | 105/199.1 |
| 4,555,095 | 11/1985 | Dickhart et al. | 267/4 |
| 4,561,360 | 12/1985 | Mulcahy | 105/199.5 |
| 4,583,464 | 4/1986 | Harwood | 105/199.5 X |
| 4,589,346 | 5/1986 | Miller | 105/199.5 X |
| 4,699,065 | 10/1987 | Kibble | 105/199.5 |
| 4,765,251 | 8/1988 | Guins | 267/4 X |
| 4,771,703 | 9/1988 | Brodeur et al. | 105/199.5 X |

*Primary Examiner*—Douglas C. Butler

*Attorney, Agent, or Firm*—Edward J. Brosius; Charles E. Bouton

[57] ABSTRACT

The present invention provides a single axle railway truck. An axle box with journal bearings is provided at each axle end. Each axle box includes a spring support from which two springs extend upwardly wherein their upper ends are received in spring retainers. The spring retainers extend from a lower surface of suppport beams and, accordingly, the support beams are themselves supported by the springs. A cylindrical dampening device has its lower end connected to the axle box and its upper end to a bracket extending outwardly from the support beam. A traction rod, or alternatively a shock absorber, extends from a side of the axle box to a mounting bracket near an end of the support beam.

12 Claims, 4 Drawing Sheets

SINGLE AXLE SUSPENSION SYSTEM FOR RAILWAY CAR TRUCK

BACKGROUND OF THE INVENTION

The present invention relates to railway car trucks and, more particularly, to single axle railway car trucks.

The most common trucks for use with railway freight cars are four-wheel trucks wherein two axles, each connected to two wheels, are joined between laterally spaced side frames having a bolster extending therebetween. Such trucks are designed to support considerable loads with each car utilizing two separate four-wheel trucks.

When the railroad car is not required to support heavy loads, for example in carrying automotive trailers or single containers, then the load carrying capacity of the truck can be reduced substantially. One type of railroad truck designed to carry such reduced loads utilizes a single axle joining two wheels and supported from a single axle suspension system. The axle ends are supported in journal bearings which themselves act as supports for the railway freight car.

Two known single axle railway car trucks are shown in U.S. Pat. No. 4,445,439 and U.S. Pat. No. 4,561,360, both assigned to the assignee of the present invention. One problem with the swing hanger design truck shown in U.S. Pat. 4,445,439 is that the design is fairly complicated and, accordingly, expensive to produce. Another problem with known single axle railway trucks relates to the poor curving or lateral stability of such trucks when subjected to normal freight car speeds and track curving conditions. It is accordingly an object of the present invention to provide an improved single axle railway car truck having improved curving characteristics and lateral stability.

SUMMARY OF THE INVENTION

Each single axle railway truck suspension system, in accordance with the present invention, comprises a single axle held between two railway wheels, with each end of the axle extending into journal roller bearings within an axle box. The axles extend laterally between two side frames or load support beams which form the structural part of the truck assembly. Each axle box includes a pair of longitudinally disposed platforms or spring seats which extend to either side of the axle. Coil spring assemblies rest on the spring seats and extend upwardly into spring retainers. The spring retainers extend downwardly from a lower portion of the load support beam.

To provide damping to both vertical and lateral motions of the axle wheelset relative to the car body, a mounting bracket extends laterally outwardly from a portion of the respective load support beam above each end of the axle. A cylindrical or elongated damping device such as a shock absorber is connected between the load support beam bracket and a second receiving bracket on a lower portion of the axle box. As the top end of the damping device extends laterally outwardly from the vertical, the damping device provides both vertical and lateral damping to motions of the wheelset relative to the car body.

Structural cross pieces extend laterally between the load support beams to complete the structural assembly of the railway truck. A bracket extends downwardly from each lateral end of the structural cross pieces. A traction rod or alternatively a shock absorber is connected between the structural cross piece bracket and an end section of the axle box. Such traction rods or shock absorbers provide restraint or control of relative yaw motions of the railway truck.

Various axle guards and combinations of stops are also provided to limit relative horizontal and vertical displacements of the wheelset.

DESCRIPTION OF THE PREFERRED EMBODIMENTS

Figure 1:
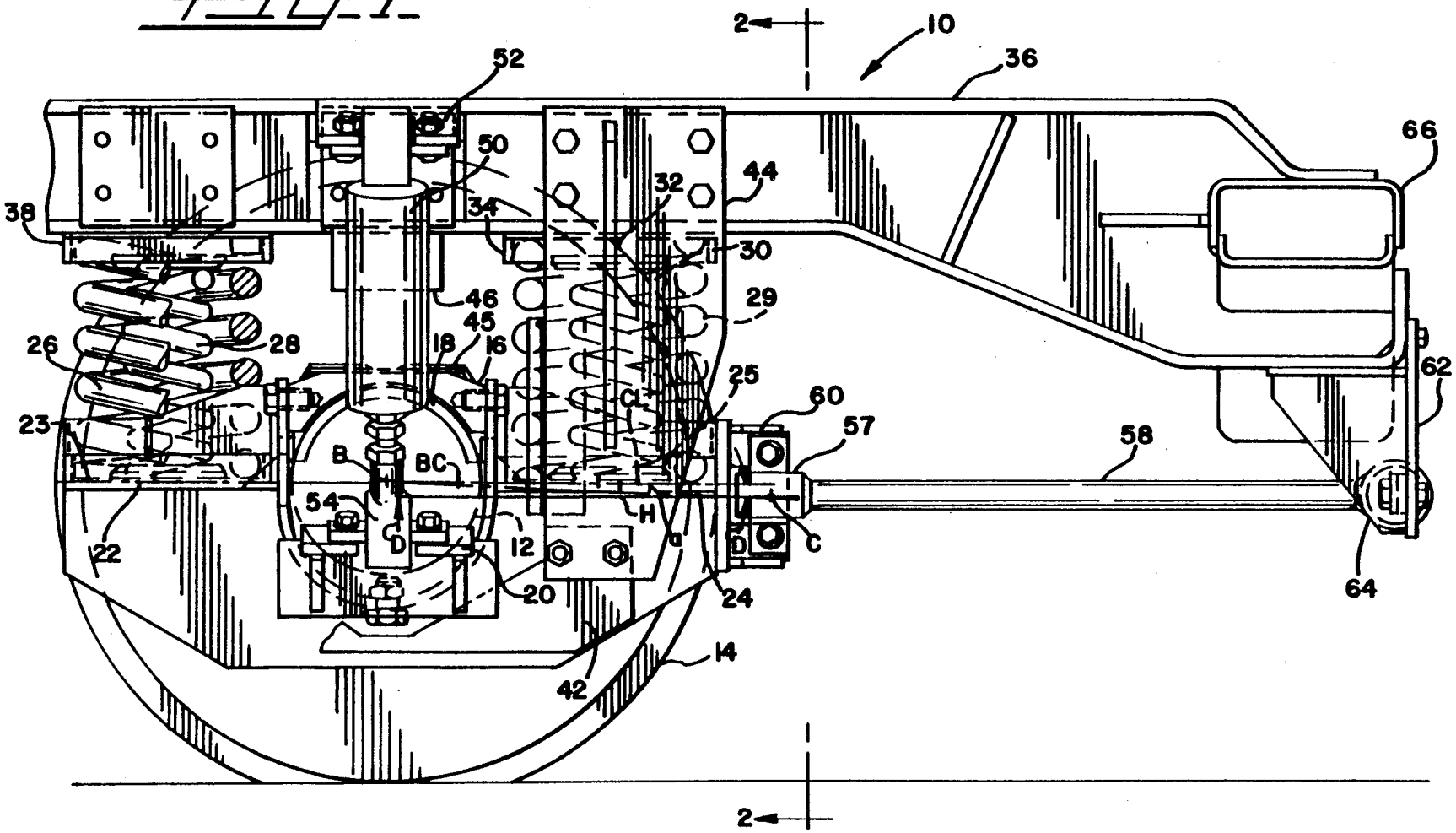
FIG. 1 is a side view, in partial cross section, of a first embodiment of a single axle railway truck in accordance with the present invention.
Figure 2:
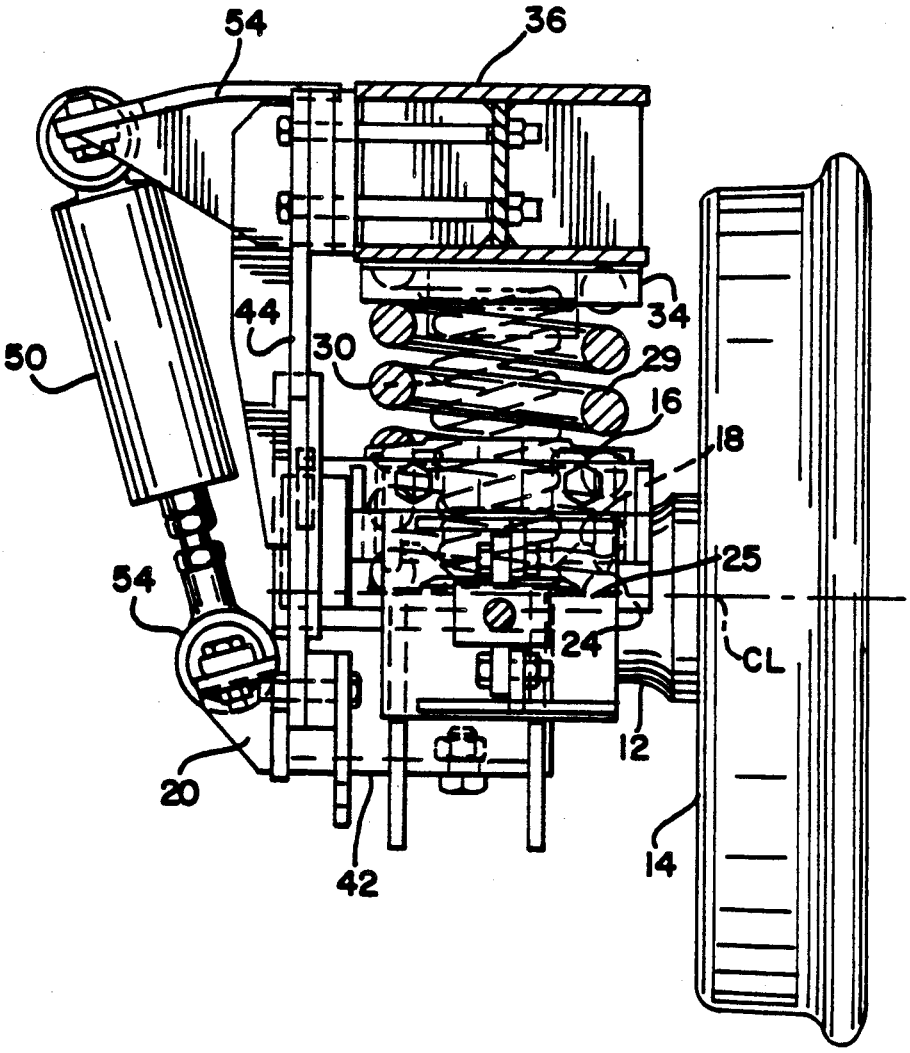
FIG. 2 is a sectional view along lines 2—2 of the single axle railway truck shown in FIG. 1.

Referring now to FIGS. 1 and 2 of the drawings, a single axle railway truck in accordance with a first embodiment of the present invention is shown generally at 10. It will be understood that one side of railway truck 10 is shown in FIGS. 1 and 2, with the other side being similar but not shown in the drawings.

Axle 12 is received in railway wheel 14 and a similar wheel (not shown) in the other side of railway truck 10. The end of axle 12 is received in axle box 16 and rotates about journal bearings 18 within axle box 16. As shown, axle box 16 surrounds axle end 18 and includes a bottom bracket section 20. Axle box 16 also includes longitudinally disposed platforms 22 and 24 which extend to either side of axle 12. Platform 22 includes an upper surface 23 which forms a spring seat upon which coil spring 26 and inner elastomeric spring 28 are positioned. Likewise, platform 24 includes a spring seat 25 upon which coil spring 29 and internally positioned elastomeric spring 30 are rested. Spring positioning device 32 extends downwardly within both elastomeric spring 30 and coil spring 29 to insure their positioning on spring seat 25. A similar spring positioning device is present but is not shown extending downwardly onto spring seat 23. Spring positioning device 32 extends downwardly from spring retainer 34. Spring retainer 34 is welded or held by similar means to the underside of side frame or load support beam 36. A similar spring retainer 38 is welded to the underside of load support beam 36 above spring seat 23 to receive coil spring 26 and elastomeric spring 28.

Axle guards 44 (left hand not illustrated) are generally flat, generally rectangular pieces affixed to a side of load support beam 36 and extending downwardly therefrom in general longitudinal alignment with spring seat 25. Bottom plate 42 is bolted to the bottom sections of axle guards 44 and extend below axle box 16 to limit the upward travel of load support beam 30 with respect to axle box 16.

Axle box 16 includes a raised generally flat top portion 45. A stop plate 46 extends downwardly from a lower portion of load support beam 36 and acts to limit the vertical travel of the load support beam 36 downwardly toward the axle box 16.

Bracket 52 extends laterally outwardly from an upper surface of load support beam 36 directly above axle 12. A cylindrical damping device 50 is attached at its upper end to bracket 52 and at its lower end 54 to support plate 20 which is part of the lower section of axle box 16.

Coil spring 29 and elastomeric spring 30 are also chosen such that the ratio of lateral to vertical load rates or stiffnesses should be between 0.7 and 0.9. This preferred ratio refers to nominal static, axial or vertical deflections under both empty and loaded railway car conditions with lateral load rates averaged over the anticipated range of lateral deflections. Spring rate ratios outside of this range result in significant deterioration in lateral stability of the railway car.

The angled mounting of damping device 50 provides damping to both vertical and lateral motions of the axle wheelset relative to the car body.

To provide additional restraint for yaw motions, traction rod 58 is provided extending from a bracket 60 at a lateral end of axle box 16 with an end 59 of traction rod 58 therein received. The other end 64 of traction rod 58 is received in bracket 62 which extends downwardly from a structural cross piece 66. Structural cross piece 66 extends from a lateral end of load support beam 36 laterally across the railway truck 10 to a similar load support beam (not shown) on the other side of railway truck 10. It is desirable that the center line 21 of the axis of traction rod 58 shown at C is in vertical alignment with the center line CL of axle 12 or else within 1.75 inches (4.5 cm.), shown as distance D, with the center line CL of axle 12. Further, angle a which is the angle between the center line CL of axle center B and the line BC between axle center B and the connection center C of traction rod 58 should be less than 10°.

Figure 3:
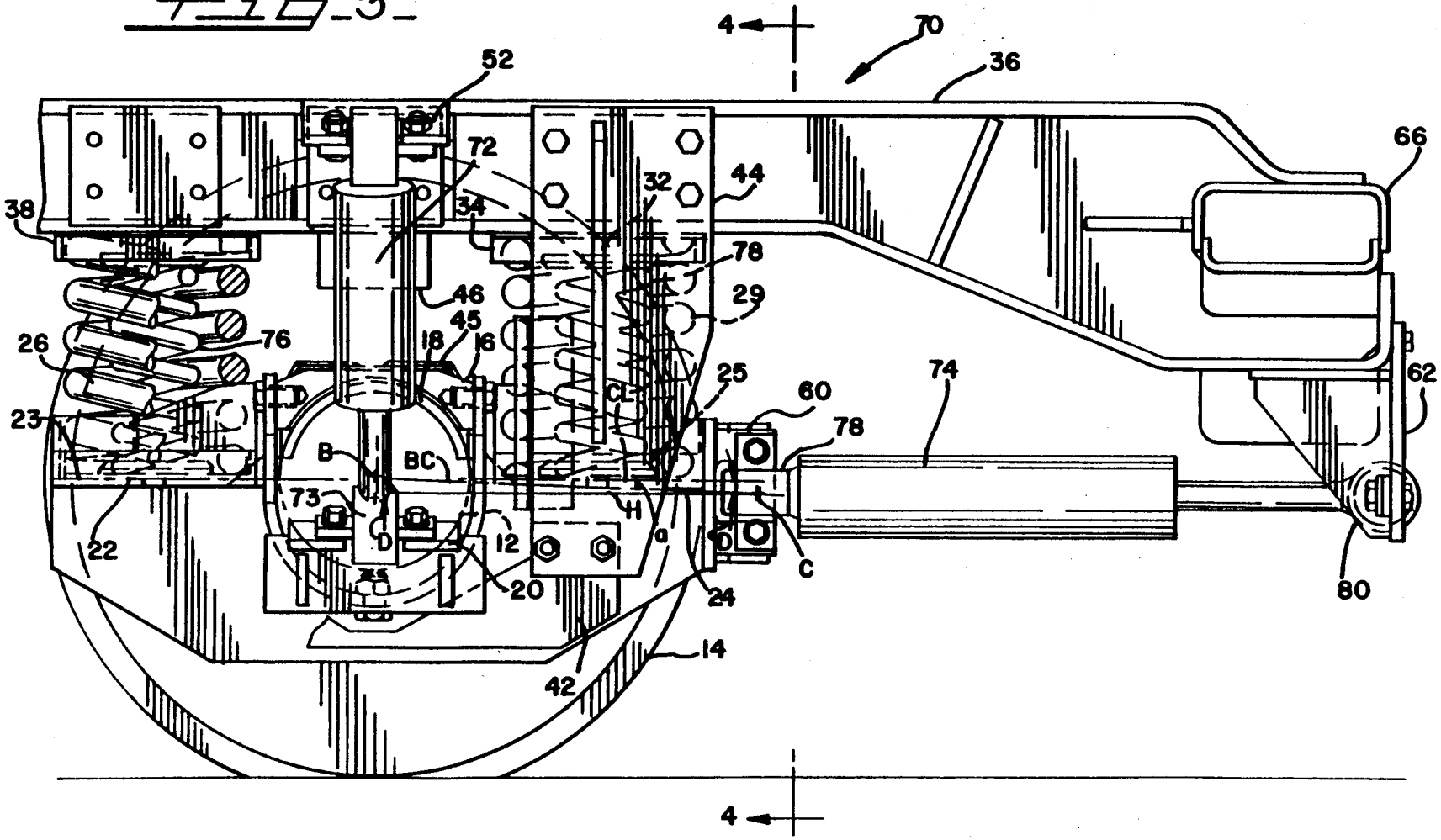
FIG. 3 is a side view in partial cross section of a second embodiment of a single axle railway truck in accordance with the present invention.
Figure 4:
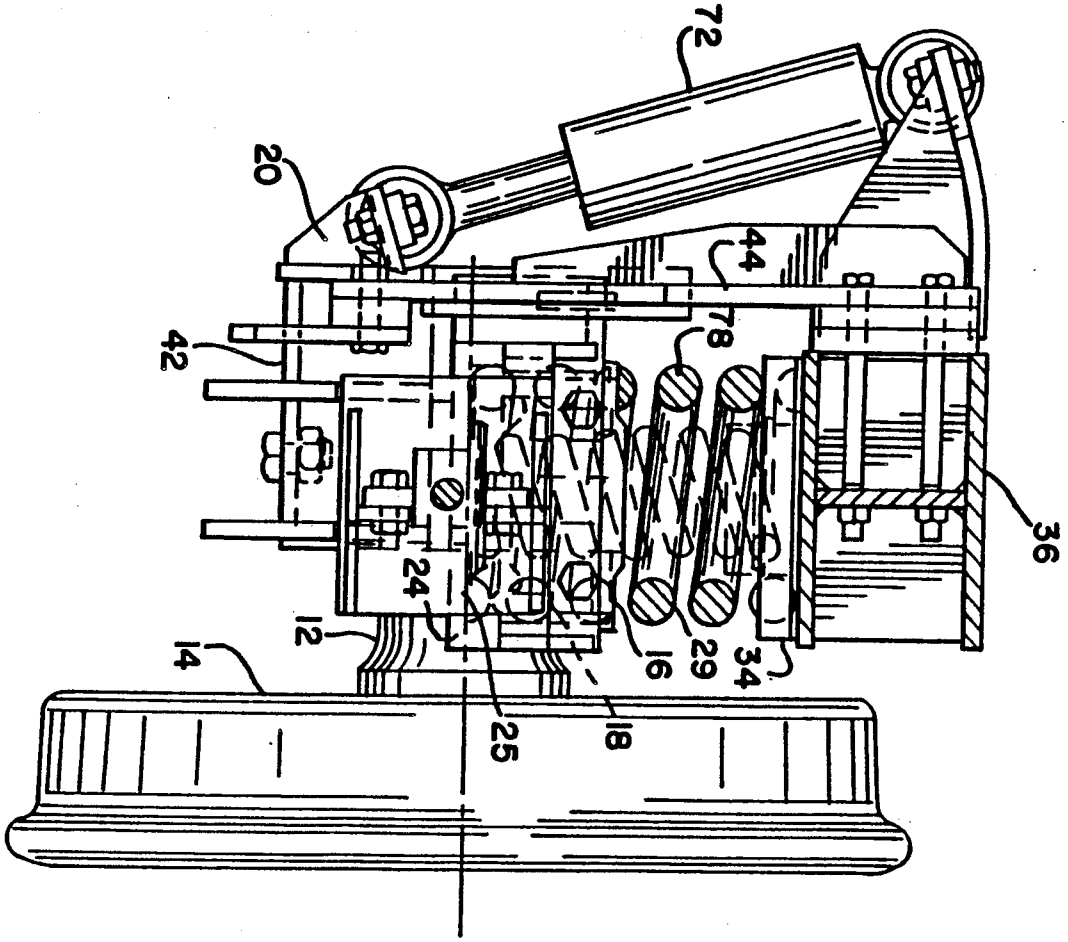
FIG. 4 is a cross sectional view along lines 4—4 of the embodiment of the single axle railway truck of the present invention shown in FIG. 3.

Referring now to FIGS. 3 and 4 of the drawings, a second embodiment of the present invention is shown generally as railway truck 70. Several components of railway truck 70 are identical to components of railway truck 10, and are numbered identically with the corresponding components shown in FIGS. 1 and 2. Such components will not be described with reference to FIGS. 3 and 4. Accordingly, only those components of railway truck 70 which differ from the components of railway truck 10 will be described herein.

Referring to spring seats 23 and 25, elastomeric springs 28 and 30 are now shown as a coil spring 76 and 78, respectively. The same lateral to vertical load ratios discussed above with reference to railway truck 10 apply to the spring groups of railway truck 70.

Shock absorber 72 is connected between bracket 52 with lower end 73 connected to bracket 20 on axle box 16. Finally, a hydraulic shock absorber 74 has replaced traction rod 58 and extends with one end 78 connected to side bracket 60 of axle box 16 and its other end 80 connected to bracket 62 extending downwardly from structural cross piece 66. The same preferred distance D between center line C of hydraulic shock absorber 74 and center line CL of axle 12 applies as described above with reference to traction rod 58 in railway truck 10.

What is claimed is:

1. A railway car truck comprising two load support beams each extending longitudinally near an edge of said truck, a single axle extending laterally between two railway wheels, two axle boxes each having journal bearings therein and each receiving an end of said axle, each axle box having a pair of spring seats longitudinally disposed on either side of said axle, a coil spring in each of said spring seats, and a secondary spring within said coil spring, two spring retainers affixed to said load support beams above each axle box such that each of said coil springs and said secondary springs is received in one of said spring retainers to support said support beams, a mounting bracket extending laterally outwardly from said load support beam, and damping means comprising a shock absorbing member having its bottom end affixed to an outer edge of said axle box and its top end to said mounting bracket such that said shock absorbing member is mounted at an acute angle laterally outwardly from the vertical to provide for vertical and lateral damping to motions of the axle relative to the load support beam, a first bracket extending from an end of said load support beam, and a second bracket extending from said axle box, and a restraining member for yaw control mounted between said axle box second bracket and said first bracket on said load support beam.

2. The railway car truck of claim 1 further comprising a stop member means affixed to said load support beam and a flat top surface on said axle boxes below said stop member means to limit horizontal displacements of said axle by the contact of said flat top surface of said axle box with said stop member means.

3. The railway car truck of claim 1 further comprising an axle guard means affixed to said load support beam, said axle guard means extending downwardly to interact with said axle box to limit the horizontal displacement of said axle.

4. The railway car truck of claim 1 wherein the ratio of lateral to vertical stiffness for said coil springs is 0.7 to 0.9.

5. The railway car truck of claim 1 wherein said secondary springs comprise elastomeric springs extending between said spring retainers and said spring seats.

6. The railway car truck of claim 1 wherein said secondary springs comprise a second coil spring extending between said spring retainers and said spring seats.

7. The railway car truck of claim 1 wherein said restraining member mounted between said axle box and said bracket on said load support beam comprises a traction rod.

8. The railway car truck of claim 7 wherein said traction rod is mounted to said axle box at a point no greater than 1.75 in. (4.5 cm) above or below the axle center line.

9. The railway car truck of claim 7 wherein said traction rod is mounted such that the inclination of the traction rod with respect to the horizontal with the car on level track is less than 10°.

10. The railway car truck of claim 1 wherein said restraining means mounted between said axle box and said bracket on said load support beam comprises a shock absorbing means.

11. The railway car truck of claim 10 wherein said shock absorbing means is mounted to said axle box at a point no greater than 1.75 in. (4.5 cm) above or below the axle center line.

12. The railway car truck of claim 10 wherein said shock absorbing means is mounted such that the inclination of the shock absorbing means with respect to the horizontal with the car on level track is less than 10°.

* * * * *